US008311445B2

(12) United States Patent
Shiiya et al.

(10) Patent No.: US 8,311,445 B2
(45) Date of Patent: Nov. 13, 2012

(54) IMAGE FORMING APPARATUS AND IMAGE FORMING METHOD

(75) Inventors: Tomoyuki Shiiya, Nagano (JP); Ken Ikuma, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 288 days.

(21) Appl. No.: 12/851,950

(22) Filed: Aug. 6, 2010

(65) Prior Publication Data

US 2011/0076052 A1 Mar. 31, 2011

(30) Foreign Application Priority Data

Sep. 25, 2009 (JP) ..... 2009-220638

(51) Int. Cl.
*G03G 15/16* (2006.01)
*G03G 21/00* (2006.01)

(52) U.S. Cl. ..... 399/101; 399/348; 399/358

(58) Field of Classification Search ..... 399/101, 399/348, 358
See application file for complete search history.

(56) References Cited

U.S. PATENT DOCUMENTS

| | | | | |
|---|---|---|---|---|
| 7,224,930 | B2 * | 5/2007 | Oda et al. | 399/359 |
| 7,406,289 | B2 * | 7/2008 | Lee | 399/349 |
| 2004/0213598 | A1 * | 10/2004 | Mori et al. | 399/101 |
| 2007/0223980 | A1 | 9/2007 | Fukumoto et al. | |

FOREIGN PATENT DOCUMENTS

JP 2008-209426 A 9/2008

* cited by examiner

*Primary Examiner* — Joseph S Wong
(74) *Attorney, Agent, or Firm* — Global IP Counselors, LLP

(57) ABSTRACT

An image forming apparatus includes: a latent image bearing member on which a latent image is formed; a developing unit that develops the latent image using a liquid developer; a transfer member onto which the image is transferred; a cleaning unit that cleans the latent image bearing member; a cleaning roller, to which a bias is applied, that cleans the transfer member by making contact with the transfer member; a blade that cleans the cleaning roller by making contact with the cleaning roller; a cleaning blade that cleans the transfer member cleaned by the cleaning roller by making contact with the transfer member; a holding unit that holds collected material scratched by the blade and the cleaning blade; an application unit that applies the collected material to the cleaning roller; and a transport channel that transports the collected material collected by the cleaning unit to the holding unit.

8 Claims, 8 Drawing Sheets

WHEN APPLICATION ROLLER IS SPONGE ROLLER

WHEN APPLICATION ROLLER IS SOLID ROLLER

IMAGE FORMING APPARATUS AND IMAGE FORMING METHOD

BACKGROUND

1. Technical Field

The present invention relates to an image forming apparatus and an image forming method that form an image by developing a latent image formed upon a photosensitive member using a liquid developer composed of toner and a carrier, transferring the resulting developer image onto a transfer material such as recording paper, and furthermore fixing the toner image onto the transfer material onto which the toner image was transferred.

2. Related Art

Various image forming apparatuses that develop and visualize latent images using a high-viscosity liquid developer in which is dispersed toner composed of solid components within a liquid carrier have been proposed. The developer used in such image forming apparatuses has solid content (toner particles) suspended within an electrically-insulative, high-viscosity organic carrier (carrier liquid) composed of silicone oil, mineral oil, cooking oil, or the like; the toner particles are extremely small, with a particle diameter in the vicinity of 1 μm. By using such small toner particles, a wet-type image forming apparatus is capable of realizing higher image qualities than dry-type image forming apparatuses, which use powder toner particles having a particle diameter of approximately 7 μm.

With past electrophotographic-type image forming apparatuses that consume a liquid developer, image formation has been carried out by first transferring a toner image formed by a developing unit into a transfer member, and then performing a secondary transfer of the transferred toner image onto a transfer material such as recording paper. With respect to the transfer member onto which the toner image is transferred by the developing unit, a belt-type member, a roller-type member, or the like is used, and the surface of the transfer member can be repeatedly used any number of times. Accordingly, the surface of the transfer member following the secondary transfer is prepared for a new image formation after remaining toner that still adheres to the transfer member is removed by a cleaning unit provided so as to make contact with the transfer member.

JP-A-2008-209426 discloses a cleaning apparatus used in an image forming apparatus that employs liquid developer, the cleaning apparatus including a preliminary cleaning unit that causes toner particles that have adhered to the surface of an image bearing member to be suspended in a carrier liquid, a toner particle collecting unit that collects suspended toner particles using static electricity, and a carrier liquid collecting unit that collects the carrier liquid from the surface of the image bearing member. According to this cleaning apparatus, the toner particle collection efficiency can be improved by the preliminary cleaning unit causing the toner particles to be suspended in the carrier liquid and then collecting the toner particles by causing the toner particles to undergo electrophoresis through the static electricity applied by the toner particle collecting unit.

In addition, JP-A-2008-209426 also discloses suppressing the use of carrier liquid by reusing the carrier liquid used by the preliminary cleaning unit. FIG. 6 of JP-A-2008-209426 illustrates a cleaning liquid supply/reuse apparatus 400 that reuses carrier liquid collected by an intermediate transfer member cleaning apparatus 30.

The cleaning liquid supply/reuse apparatus 400 includes four tanks, or a cleaning liquid tank 401 that stores the cleaning liquid, a toner particle collection tank 305 that holds toner collected by a toner particle collection roller 32, a waste liquid tank 402 that stores carrier liquid and cleaning liquid collected by a blade 33, and a mixing tank 404 that pumps the liquids in the cleaning liquid tank 401 and the waste liquid tank 402 using a pump 403 and mixes those liquids.

The mixture of the carrier liquid and cleaning liquid in the mixing tank 404 is supplied to a preliminary cleaning roller 31 by the pump 403. Meanwhile, the mixture of the carrier liquid and the cleaning liquid collected by the blade 33 is sent to the mixing tank 404 after being filtered in the waste liquid tank 402. Furthermore, the toner collected by the toner particle collection roller 32 is wiped off by a toner particle collection blade 35 that makes contact with the surface of the toner particle collection roller 32, and is then held in the toner particle collection tank 305.

However, with the cleaning liquid supply/reuse apparatus 400 disclosed in JP-A-2008-209426, four tanks, or the cleaning liquid tank 401, the toner particle collection tank 305, the waste liquid tank 402, and the mixing tank 404, as well as the components, pumps, and so on to connect each of the tanks, are necessary in order to reuse the cleaning liquid, which makes it difficult to achieve a reduction in size of the cleaning apparatus and, by extension, in size of the image forming apparatus as well.

In addition, with the cleaning apparatus in JP-A-2008-209426, it is necessary to dispose the preliminary cleaning unit, the toner particle collecting unit, and the carrier liquid collecting unit so as to make contact with the surface of the intermediate transfer member, which is the entity to be cleaned. In such a case, a certain amount of surface area on the intermediate transfer member is required, but in the case where the surface area of the portion that can be cleaned is limited, as with a belt-type intermediate transfer member, installing the cleaning apparatus is difficult to begin with. Furthermore, increasing the number of components makes it difficult to achieve a reduction in size of the cleaning apparatus and, by extension, in size of the image forming apparatus as well.

SUMMARY

An advantage of some aspects of the invention is to provide an image forming apparatus and an image forming method that enable, in a cleaning apparatus that cleans a transfer member, the effective reuse of liquid used in the cleaning of the transfer member, as well as a reduction in size of the cleaning apparatus and the image forming apparatus.

An image forming apparatus according to an aspect of the invention includes: a latent image bearing member on which a latent image is formed; a developing unit that develops the latent image formed on the latent image bearing member using a liquid developer containing toner particles and a carrier liquid; a transfer member onto which the image developed on the latent image bearing member by the developing unit is transferred; a cleaning unit that cleans the latent image bearing member; a cleaning roller, to which a bias is applied, that cleans the transfer member by making contact with the transfer member; a blade that cleans the cleaning roller by making contact with the cleaning roller; a cleaning blade that cleans the transfer member cleaned by the cleaning roller by making contact with the transfer member; a holding unit that holds collected material wiped off by the blade and the cleaning blade; an application unit that applies the collected material held in the holding unit to the cleaning roller; and a transport channel that transports the collected material collected by the cleaning unit to the holding unit.

Furthermore, the image forming apparatus according to the aspect of the invention further includes: a second transport channel that transports the collected material held in the holding unit to a second holding unit; and a third transport channel that transports the collected material held in the second holding unit to the holding unit.

Furthermore, the image forming apparatus according to the aspect of the invention further includes a filter unit that collects toner particles contained in the collected material held in the second holding unit.

Furthermore, the image forming apparatus according to the aspect of the invention further includes: a concentration detection unit that detects a concentration of toner particles in the collected material held in the holding unit; and a control unit that controls the transport of the collected material held in the holding unit based on the concentration of the toner particles in the collected material detected by the concentration detection unit.

Furthermore, in the image forming apparatus according to the aspect of the invention, the control unit controls the amount of collected material transported through the second transport channel.

Furthermore, in the image forming apparatus according to the aspect of the invention, the control unit controls the amount of collected material transported through the transport channel.

Furthermore, the image forming apparatus according to the aspect of the invention further includes: a second concentration detection unit that detects a concentration of toner particles in the collected material held in the second holding unit; a third holding unit that holds the transported collected material to be held in the second holding unit; and a fourth transport channel that transports the collected material held in the second holding unit to the third holding unit; and the control unit controls the amount of the collected material transported through the fourth transport channel based on the concentration of toner particles in the collected material held in the second holding unit detected by the second concentration detection unit.

Meanwhile, an image forming method according to an aspect of the invention includes: developing a latent image formed upon a latent image bearing member using a liquid developer containing toner particles and a carrier liquid; transferring the image developed on the latent image bearing member onto a transfer member; cleaning the latent image bearing member using a cleaning unit; transporting collected material collected by the cleaning unit to a holding unit; cleaning the transfer member by causing a cleaning roller to which a bias is applied to make contact with the transfer member; cleaning the cleaning roller by causing a blade to make contact with the cleaning roller; cleaning the transfer member that has been cleaned by the cleaning roller by causing a cleaning blade to make contact with the transfer member; holding the collected material wiped off by the blade and the cleaning blade in the holding unit, and holding the collected material collected by the cleaning unit in the holding unit; and applying the collected material held in the holding unit to the cleaning roller.

As described thus far, according to the image forming apparatus and the image forming method of the invention, an improvement in the efficiency with which the developer is used can be achieved by supplying, to the cleaning roller that cleans the transfer member, collected material collected by the cleaning unit that cleans the latent image bearing member. In addition, because it is sufficient to provide at least one holding unit for the cleaning roller, the size of the cleaning apparatus and, by extension, the image forming apparatus, can be reduced. Furthermore, because collected material, containing dispersant, from the latent image bearing member can be used, the efficiency at which the toner particles are attracted from the transfer member to the cleaning roller can be improved, thus making it possible to achieve an improvement in the cleaning properties.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
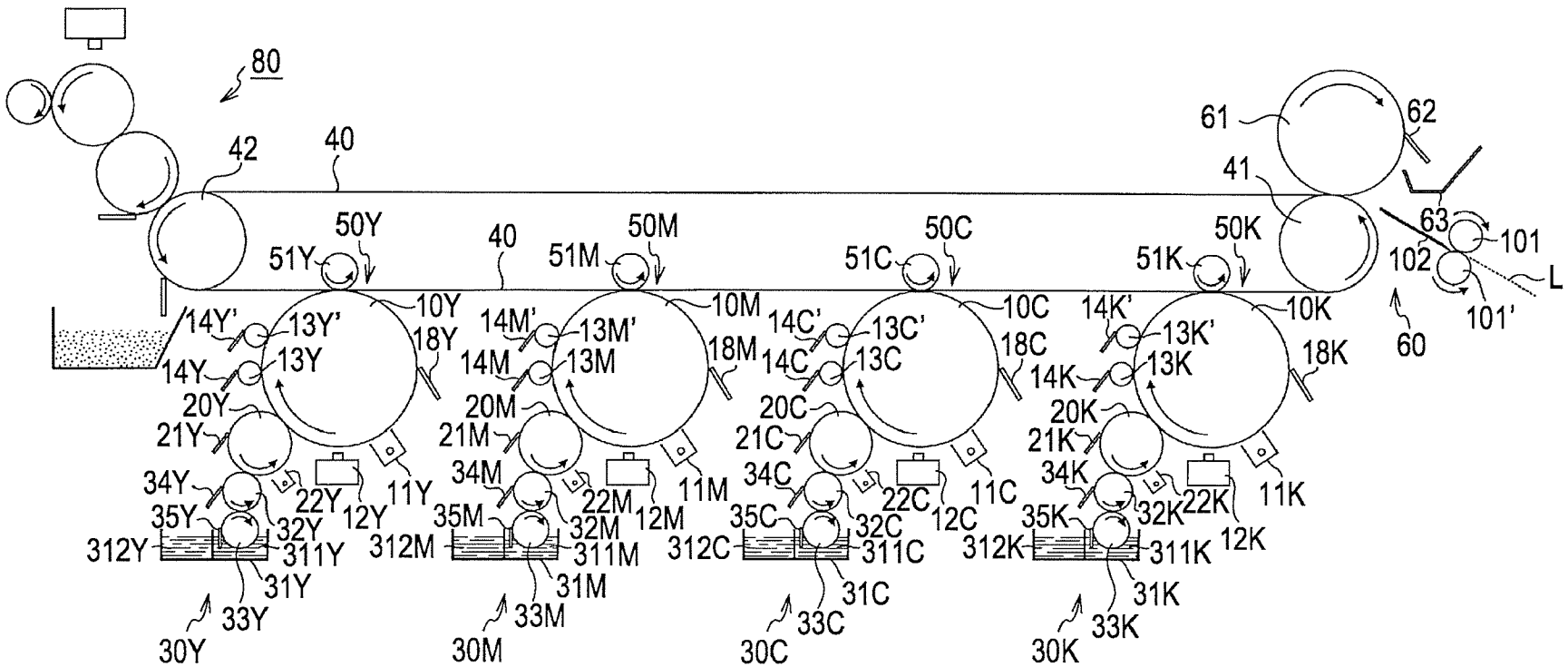
FIG. 1 is a diagram illustrating the main configuration of an image forming apparatus according to an embodiment of the invention.

Embodiments of the invention will be described hereinafter with reference to the drawings. FIG. 1 is a diagram illustrating the main configuration of an image forming apparatus according to an embodiment of the invention. The image forming apparatus of this embodiment is configured of: a transfer belt 40; four image forming units configured primarily of photosensitive members 10Y, 10M, 10C, and 10K; four developing units 30Y, 30M, 30C, and 30K disposed corresponding to the respective photosensitive members 10Y, 10M, 10C, and 10K ("latent image bearing members" according to the invention); a secondary transfer section that is disposed to the right of the transfer belt 40 as seen in FIG. 1; a cleaning unit that is disposed to the left of the transfer belt 40 as seen in FIG. 1; and so on.

Because the configurations of each of the image forming units and each of the developing units 30Y, 30M, 30C, and 30K are the same, only the image forming unit and developing unit for yellow (Y) will be described hereinafter.

The developing unit 30Y is a unit that develops a latent image formed using liquid developer upon the photosensitive member 10Y, and includes, as its main constituent elements, a developing roller 20Y, an intermediate roller 32Y, a anilox roller 33Y, a liquid developer reservoir 31Y that stores the liquid developer, and a toner charging unit 22Y that charges toner upon the developing roller 20Y.

A cleaning blade 21Y, the intermediate roller 32Y, and the toner charging unit 22Y are disposed in the outer circumference of the developing roller 20Y. The surface of the intermediate roller 32Y is contacted by the developing roller 20Y and the anilox roller 33Y, and an intermediate roller cleaning blade 34Y is disposed in the outer circumference thereof. A regulation member 35Y that adjusts the amount of liquid developer pumped from the liquid developer reservoir 31Y makes contact with the anilox roller 33Y. Note that with a three-roller type that uses the intermediate roller 32Y, as is the case with the developing unit according to this embodiment, the amount of liquid developer is adjusted by the intermediate roller 32Y making contact with the anilox roller 33Y, and thus a configuration in which the regulation member 35Y is not provided can be employed as well.

The liquid developer held in the developer reservoir 31Y is a non-volatile liquid developer, which is non-volatile at normal temperatures, and which has a high concentration and high viscosity, rather than a volatile liquid developer that uses Isopar (a trademark of Exxon) as its carrier, which is volatile at normal temperatures, has a low concentration (approximately 1-2 wt %), and that has a low viscosity, as has generally been used in the past. In other words, the liquid developer in the invention is a high-viscosity liquid developer (that is, a viscoelasticity of approximately 30 to 300 mPa·s at a shear rate of 1000 (1/s) at 25° C., measured using a HAAKE Rheo-Stress RS600) with a toner solid content concentration of 20%, in which solid particles of a colorant such as a pigment having an average particle diameter of 1 μm are dispersed within a thermoplastic resin and are added to a liquid carrier such as an organic carrier, silicone oil, mineral oil, or cooking oil along with a dispersant.

The anilox roller 33Y functions as an application roller that supplies and applies liquid developer to the intermediate roller 32Y. The anilox roller 33Y is a cylindrical member, and is a roller whose surface is formed as a non-planar surface by engraving minute channels in a uniform helical pattern in that surface so as to make it easier for the surface to hold developer. The liquid developer is supplied from the developer reservoir 31Y to the developing roller 20Y by this anilox roller 33Y. When the apparatus is operating, the anilox roller 33Y rotates in the clockwise direction, as shown in FIG. 1, thus applying liquid developer to the intermediate roller 32Y.

The regulation member 35Y is a metallic blade approximately 200 μm in thickness, and adjusts the amount of liquid developer supplied to the developing roller 20Y by making contact with the surface of the anilox roller 33Y and regulating the film thickness and amount of liquid developer that is borne and transported by the anilox roller 33Y.

The intermediate roller 32Y is a cylindrical member and, like the developing roller 20Y, rotates central to a rotational axis in the counter-clockwise direction, making counter-contact with the developing roller 20Y, as shown in FIG. 1. Like the developing roller 20Y, the intermediate roller 32Y is configured by providing an elastic layer upon the outer circumference of a metallic center.

The intermediate roller cleaning blade 34Y is disposed downstream from the position of contact between the intermediate roller 32Y and the developing roller 20Y, making contact with the intermediate roller 32Y; the intermediate roller cleaning blade 34Y wipes off liquid developer that was not supplied to the developing roller 20Y, and that liquid developer is then collected in a collected liquid holding portion 312Y within the developer reservoir 31Y.

The developing roller 20Y is a cylindrical member, and rotates counter-clockwise central to a rotational axis, as shown in FIG. 1. The developing roller 20Y has an elastic layer such as polyurethane rubber, silicone rubber, NBR, PFA tubing, or the like provided upon the outer circumference of an inner core of metal such as iron.

The developing roller cleaning blade 21Y is configured of rubber or the like that makes contact with the surface of the developing roller 20Y; the developing roller cleaning blade 21Y is disposed downstream, in the rotational direction of the developing roller 20Y, from a developing nip portion formed at a position where the developing roller 20Y and the photosensitive member 10Y make contact with each other, and removes residual liquid developer from the developing roller 20Y by wiping off that liquid developer. The developer remaining after this developing is wiped off and removed by the developing roller cleaning blade 21Y; the removed developer drops into the collected liquid holding portion 312Y within the developer reservoir 31Y, and is reused.

The toner charging unit 22Y (charging member) is an electrical field application unit that increases a charge bias at the surface of the developing roller 20Y, and an electrical field is applied to the liquid developer transported by the developing roller 20Y through a corona discharge at a position near the toner charging unit 22Y, thus charging the liquid developer. Note that the electrical field application unit for this toner charging may employ a compaction roller, rather than employing a corona discharge from a corona discharge unit. It is preferable for such a compaction roller to be a cylindrical member, structured having a conductive resin layer or rubber layer provided on the surface of a metallic roller base material, and to rotate in, for example, the direction opposite to the rotation of the developing roller 20Y, or the clockwise direction.

The image forming unit is configured of the following elements disposed around the outer circumference of the photosensitive member 10Y, in order along the rotational direction thereof: a corona charging unit 11Y; an exposure unit 12Y; a photosensitive member squeeze unit; a primary transfer section 50Y; a photosensitive member cleaning blade 18Y; and so on. In the outer circumference of the photosensitive member 10Y, the image forming unit makes contact with the developing roller 20Y of the developing unit 30Y between the exposure unit 12Y and a first photosensitive member squeeze roller 13Y.

The photosensitive member 10Y is a photosensitive drum configured of a cylindrical member, with a photosensitive layer such as an amorphous silicon photosensitive material formed on the outer circumferential surface thereof, and rotates in the clockwise direction.

The corona charging unit 11Y is disposed upstream in the rotational direction of the photosensitive member 10Y from the nip portion formed between the photosensitive member 10Y and the developing roller 20Y; a voltage is applied from a power source unit (not shown), thereby charging the photosensitive member 10Y with a corona discharge. The exposure unit 12Y is downstream from the corona charging unit 11Y in the rotational direction of the photosensitive member 10Y; the exposure unit 12Y irradiates the surface of the photosensitive member 10Y that has been charged by the corona charging unit 11Y with light, thereby forming a latent image upon the photosensitive member 10Y.

The photosensitive member squeeze unit, which is disposed upstream from the primary transfer section 50Y, is disposed downstream from the developing roller 20Y and opposite to the photosensitive member 10Y. The photosensitive member squeeze unit is configured of the first photosensitive member squeeze roller 13Y and a second photosensitive member squeeze roller 13Y', which are elastic roller members that rotate by sliding upon the photosensitive member 10Y, and photosensitive member squeeze roller cleaning blades 14Y and 14Y'; the photosensitive member squeeze unit functions to collect excess carrier liquid and unnecessary fog toner from the toner image developed on the photosensitive member 10Y and increase the ratio of toner particles within the visual image (the toner image). Note that a predetermined bias voltage for attracting the fog toner toward the photosensitive member squeeze rollers 13Y and 13Y' is applied to the photosensitive member squeeze rollers 13Y and 13Y'.

The photosensitive member squeeze roller cleaning blades 14Y and 14Y' are provided so as to make contact with the photosensitive member squeeze rollers 13Y and 13Y', respectively, and wipe off liquid developer containing the collected carrier liquid and fog toner, which then drops into the collected liquid holding portion 312Y within the developer reservoir 31Y.

Having passed the squeeze unit configured of the first photosensitive member squeeze roller 13Y and the second photosensitive member squeeze roller 13Y' mentioned above, the surface of the photosensitive member 10Y proceeds to the primary transfer section 50Y. At the primary transfer section 50Y, the developer image developed on the photosensitive member 10Y is transferred to the transfer belt 40 by a primary transfer backup roller 51Y. Furthermore, at the primary transfer section 50Y, the toner image upon the photosensitive member 10Y is transferred onto the transfer belt 40 due to the effects of the transfer bias applied to the primary transfer backup roller 51Y. Here, the configuration is such that the photosensitive member 10Y and the transfer belt 40 move at the same velocity, thereby reducing the driving burden for rotation and movement as well as suppressing disturbances to the visualized toner image on the photosensitive member 10Y.

The photosensitive member cleaning blade 18Y that makes contact with the photosensitive member 10Y downstream from the primary transfer section 50Y cleans liquid developer rich in carrier components from the surface of the photosensitive member 10Y.

The transfer belt 40 (transfer member) has a three-layer structure, in which a polyurethane elastic intermediate layer is provided upon a polyimide base layer, and a PFA surface layer is provided thereupon. This transfer belt 40 is used in a state in which it is stretched across a belt driving roller 41 and a tension roller 42, and the toner images are transferred on the side of the PFA surface layer. Although the transfer belt 40 is employed as the member for transferring in the image forming apparatus according to this embodiment, this member is not limited to a belt, and it is also possible to employ various types of transfer members, such as rollers, drums, and so on.

At the primary transfer sections 50Y, 50M, 50C, and 50K, which are formed by disposing the primary transfer backup rollers 51Y, 51M, 51C, and 51K opposite to the photosensitive members 10Y, 10M, 10C, and 10K with the transfer belt 40 therebetween, a full-color toner image is formed upon the transfer belt 40 by sequentially transferring the toner images of the various colors developed upon the photosensitive members 10Y, 10M, 10C, and 10K onto the transfer belt 40 in a superimposed state, using the position of contact with the photosensitive members 10Y, 10M, 10C, and 10K as transfer positions.

In a secondary transfer unit 60, a secondary transfer roller 61 is disposed opposite to the belt driving roller 41 with the transfer belt 40 therebetween, and a secondary transfer section (nip portion) is formed by the two rollers. At this secondary transfer section, a single-color or full-color toner image formed upon the transfer belt 40 is transferred onto a transfer material such as paper, film, cloth, or the like transported in a transfer material transport path L. Furthermore, a fixing unit (not shown) is disposed downstream from the transfer material transport path L, and the single-color toner image or full-color toner image transferred onto the transfer material is fixed by applying heat, pressure, or the like thereto.

The transfer material is supplied to the secondary transfer unit by a paper supply unit (not shown). Transfer material set in the paper supply unit is transported along the transfer material transport path L on a sheet-by-sheet basis at a predetermined timing. In the transfer material transport path L, the transfer material is transported to the secondary transfer section by gate rollers 101 and 101', where the single-color or full-color toner image formed upon the transfer belt 40 is transferred onto the transfer material.

The transfer belt 40 is stretched upon the tension roller 42 and the belt driving roller 41, and a cleaning apparatus 80 (cleaning unit) is disposed so as to make contact with the transfer belt 40 where the transfer belt 40 is stretched upon the tension roller 42.

Figure 2:
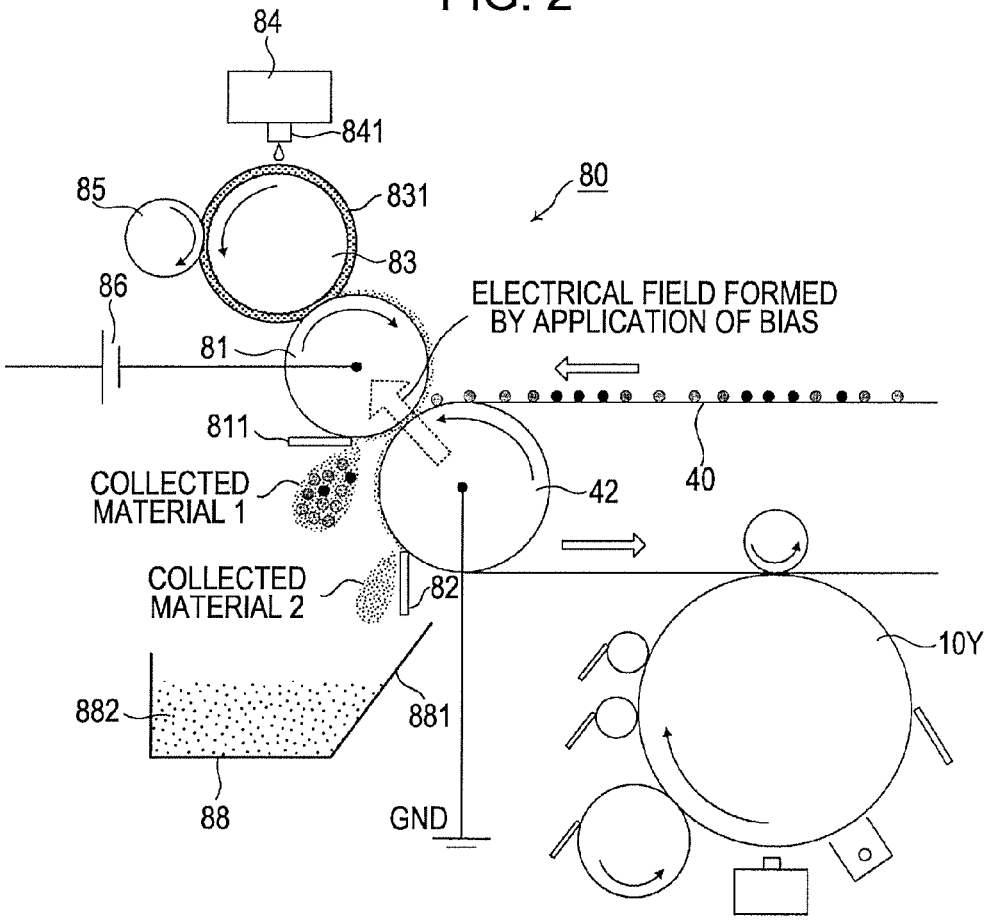
FIG. 2 is a diagram illustrating the main configuration of a cleaning unit according to the embodiment of the invention.

Next, the cleaning apparatus 80, which cleans the surface of the transfer belt 40, will be described in detail. FIG. 2 is a diagram illustrating an outline of the cleaning apparatus used in the image forming apparatus according to this embodiment of the invention. In FIG. 2, 81 indicates a cleaning roller, 811 indicates a cleaning roller cleaning blade, 82 indicates a transfer belt cleaning blade, 83 indicates an application roller, 831 indicates a sponge cover portion, 85 indicates a smoothing roller, 88 indicates a tank, 881 indicates a tank receiving portion, and 882 indicates a tank holding portion.

The cleaning roller 81 is disposed opposite to the tension roller 42 with the transfer belt 40 located therebetween, and makes contact with the transfer belt 40, thus cleaning the surface of the transfer belt 40. The cleaning roller 81 uses conductive urethane rubber as its material, and a conductive urethane coating is applied to the surface layer thereof in order to reduce the surface roughness.

A biasing voltage is applied to the cleaning roller 81 by a bias application unit 86. In this embodiment, a predetermined negative voltage is applied to the cleaning roller 81, whereas the tension roller 42 is grounded, and an electrical field is formed between the cleaning roller 81 and the tension roller 42 as a result. Toner particles charged on the positive side are attracted to the cleaning roller 81 by this electrical field, and thus with the cleaning roller 81, toner particles upon the transfer belt 40 can be collected efficiently.

The cleaning roller cleaning blade 811 is an elastic blade, having a rubber portion composed of urethane rubber or the like, that makes contact with the surface of the cleaning roller 81, and cleans the cleaning roller 81 by making contact with the cleaning roller 81 and wiping off toner particles and carrier liquid therefrom. Collected material 1 wiped off by the cleaning roller cleaning blade 811 contains more toner particles than collected material 2 collected by the transfer belt cleaning blade 82, mentioned later.

The collected material 1 wiped off by the cleaning roller cleaning blade 811 falls onto the tank receiving portion 881 of the tank 88, and ultimately accumulates in the tank holding portion 882.

The transfer belt cleaning blade 82 is disposed opposite to the tension roller 42 with the transfer belt 40 located therebetween. The transfer belt cleaning blade 82 is configured of an elastic blade or the like, having a rubber portion composed of urethane rubber or the like, that makes contact with the surface of the transfer belt 40, and cleans the transfer belt 40, which has been cleaned by the cleaning roller 81, by wiping off residual carrier liquid from the transfer belt 40.

Like the collected material 1, the collected material 2 wiped off by the transfer belt cleaning blade 82 falls onto the tank receiving portion 881 of the tank 88 and accumulates in the tank holding portion 882. The toner particles are efficiently collected by the cleaning roller 81, and the collected material held in the tank holding portion 882 is reused. The transport of the collected material and the transport of the carrier liquid will be described later.

The application roller 83 is a roller that applies carrier liquid to the cleaning roller 81, and in this embodiment, a sponge member (the sponge cover portion 831) is provided on the outer circumferential surface thereof. The cleaning roller 81 that has had carrier liquid applied by the application roller 83 carries moisture, and the carrier liquid is in a sufficiently-applied state at the nip portion formed between the cleaning roller 81 and the transfer belt 40 (the tension roller 42). In such a state, a biasing voltage that attracts the toner particles within the liquid developer is applied to the cleaning roller 81, and it is thus possible to achieve favorable cleaning properties.

Figure 3:
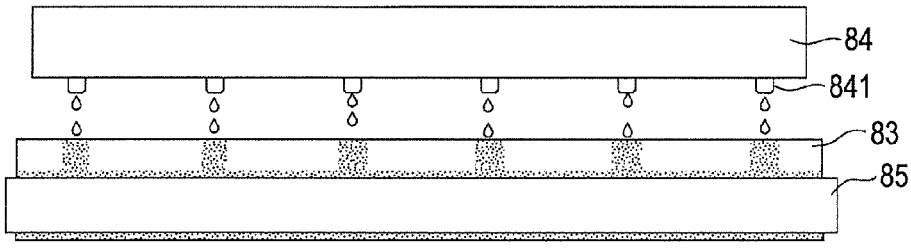
FIG. 3 is a schematic view of an application roller and a dripping unit as seen from a direction perpendicular to a roller axis direction.

A structure that supplies carrier liquid to the application roller 83 by dripping the carrier liquid thereon is a dripping unit 84, and nozzles 841 that discharge the carrier liquid are provided in the lower section thereof. FIG. 3 is a schematic view of the application roller 83, the dripping unit 84, and the smoothing roller 85 as seen from a direction perpendicular to the roller axis direction. The nozzles 841 of the dripping unit 84 are provided at an approximately uniform interval in the axial direction, and supply carrier liquid to the application roller 83 in the area immediately therebelow.

The application roller 83 that has been supplied with the carrier liquid rotates in the counter-clockwise direction, as shown in FIG. 2, moving toward the smoothing roller 85; pressure is applied to the sponge cover portion 831 by the smoothing roller 85, and as a result, the carrier liquid within the sponge cover portion 831 is distributed in the axial direction of the application roller 83.

Figure 4:
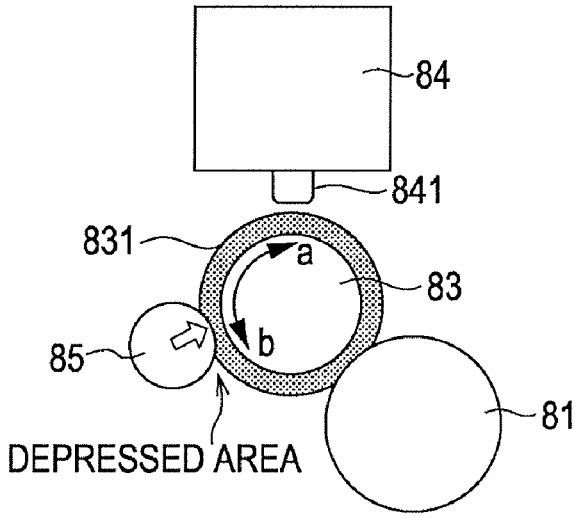
FIG. 4 is a diagram illustrating a positional relationship between the dripping unit and the application roller.

FIG. 4 is a diagram illustrating the positional relationship between the dripping unit 84 and the application roller 83. It is preferable for the carrier liquid that is dripped down from the nozzles 841 of the dripping unit 84 to be dripped within a range between a position (a), which is the uppermost position of the application roller 83 in the vertical direction, and a nip position (b), which is formed between the application roller 83 and the smoothing roller 85 (that is, within the range from (a) to (b)). With such a positional relationship, the smoothing roller 85 can smooth the carrier liquid on the application roller 83 in an approximately uniform manner in the axial direction.

Figure 5:
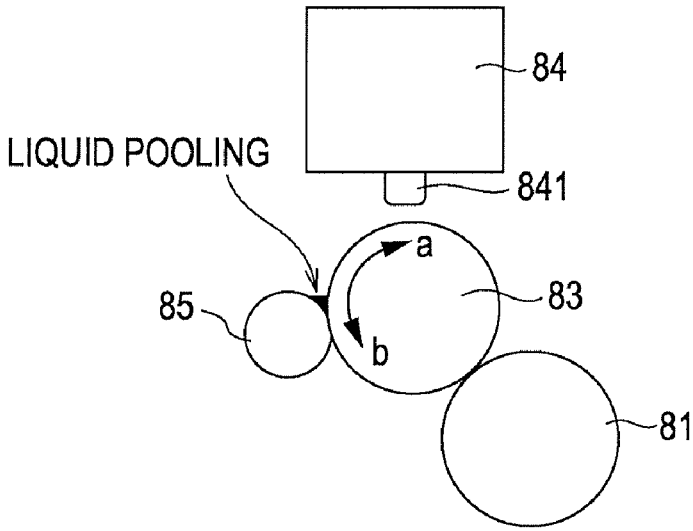
FIG. 5 is a diagram illustrating part of a cleaning apparatus according to another embodiment of the invention.

Incidentally, although this embodiment describes an example in which the application roller 83 has the sponge cover portion 831, it is also possible to employ a solid roller in which the outer circumference of the application roller 83 is formed of rubber. Such an embodiment will be explained with reference to FIG. 5. FIG. 5 is a diagram illustrating an outline of the cleaning apparatus used in the image forming apparatus according to another embodiment of the invention.

In this embodiment, a solid roller, in which the outer circumference of the application roller 83 is formed of rubber, is employed. As with the previously-described embodiment, it is preferable for the carrier liquid that is dripped down from the nozzles 841 of the dripping unit 84 to be dripped within the range between the position (a), which is the uppermost position of the application roller 83 in the vertical direction, and the nip position (b), which is formed between the application roller 83 and the smoothing roller 85 (that is, within the range from (a) to (b)).

Although the previously-described embodiment is configured so that the carrier liquid dripped onto the application roller 83 is distributed in the axial direction by applying pressure to the sponge cover portion 831 using the smoothing roller 85, this embodiment is configured so that the carrier liquid dripped onto the application roller 83 forms a pool at the nip portion between the smoothing roller 85 and the application roller 83, as shown in FIG. 5, and is distributed in the axial direction.

Thus far, the cleaning apparatus 80 has been described as being configured around the transfer belt 40, and according to the cleaning apparatus 80, toner particles and carrier liquid upon the transfer belt 40 can be collected efficiently. In particular, by applying the carrier liquid to the application roller 83 and applying a bias voltage, the toner particles can be put in a state suspended in the carrier liquid, attracted toward the application roller 83, and collected; this makes it possible to achieve an improvement in the toner particle collection efficiency.

Next, transporting the carrier liquid so as to achieve an improvement in toner particle collection efficiency in the cleaning apparatus 80 will be described. In the embodiments of the invention, the reuse of developer is achieved by collecting the carrier liquid used in the cleaning apparatus 80 by cleaning the photosensitive members 10 after the primary transfer and using the carrier liquid-rich collected material that has been collected.

First Embodiment

Figure 6:
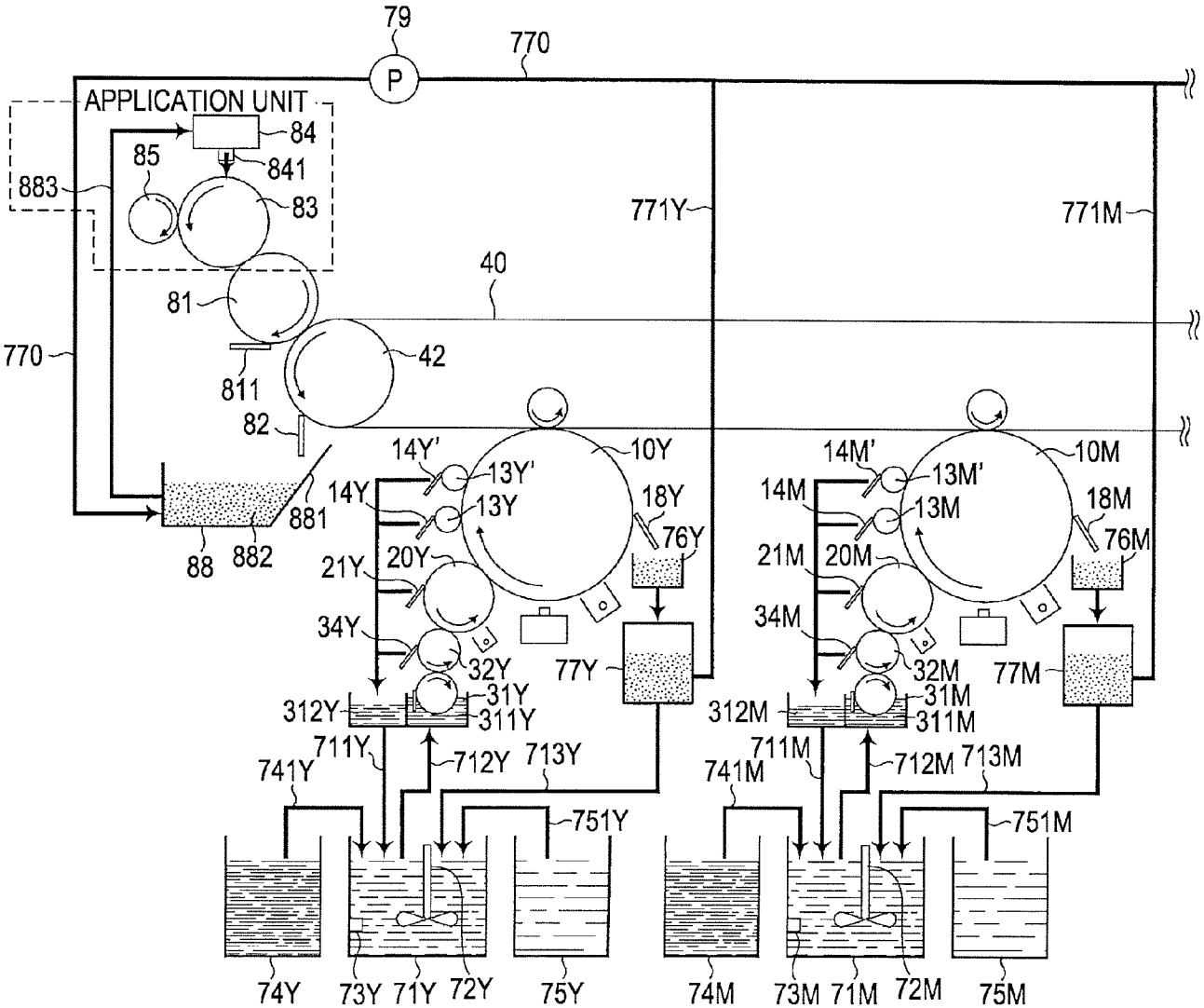
FIG. 6 is a diagram illustrating the transport of liquid developer according to an embodiment of the invention.

FIG. 6 is a diagram illustrating an image forming apparatus according to a first embodiment. First, a developer resupply unit in the periphery of the photosensitive member 10Y that achieves the reuse of developer will be described, using a unit provided in the developing unit 30Y as an example. The configurations are also the same for the developing units 30M, 30C, and 30K of the other colors.

In this embodiment, a high-concentration developer tank 74Y, a carrier liquid tank 75Y, a concentration adjustment tank 71Y, a collecting tank 76Y, a collected liquid buffer tank 77Y, transport channels connecting the respective tanks, and so on are provided as the primary configuration in the vicinity of the photosensitive member 10Y for achieving the reuse of the developer. Note that transport amounts are rendered controllable by pumps, valves, and so on provided in the respective transport channels.

The developer resupply unit is a unit that resupplies liquid developer whose concentration has been adjusted to a developer holding unit 311Y, and in this embodiment, the high-concentration developer tank 74Y, the carrier liquid tank 75Y, the concentration adjustment tank 71Y, the collecting tank 76Y, the collected liquid buffer tank 77Y, and the transport channels that connect the respective tanks are the primary constituent elements thereof. Although the carrier liquid tank 75Y is provided for each color in this embodiment, it should be noted that the carrier liquid tank 75Y can also be shared with the developer resupply units for each of the other colors. According to this configuration, a common carrier liquid can be supplied to the developer resupply units of each of the colors, which contributes to uniform qualities in the liquid developers of each of the colors and a reduction in the number of components.

The developer wiped off by the photosensitive member squeeze roller cleaning blades 14Y and 14Y', the developing roller cleaning blade 21Y, and the intermediate roller cleaning blade 34Y is first held in the collected liquid holding portion 312Y provided within the developer reservoir 31Y, and is then supplied to the concentration adjustment tank 71Y via a transport channel 711Y.

Meanwhile, the carrier liquid-rich liquid developer wiped off by the photosensitive member cleaning blade 18Y is supplied to the concentration adjustment tank 71Y via the collecting tank 76Y, the collected liquid buffer tank 77Y, and a transport channel 713Y.

Furthermore, high-concentration developer is supplied to the concentration adjustment tank 71Y from the high-concentration developer tank 74Y via a transport channel 741Y. Finally, the carrier liquid is supplied from the carrier liquid tank 75 via a transport channel 751Y.

In this manner, the developer collected by the configuration in the periphery of the photosensitive member 10Y, and unused toner and carrier liquid supplied from the high-concentration developer tank 74Y and the carrier liquid tank 75Y, are supplied to the concentration adjustment tank 71Y. A propeller-shaped agitation member 72Y is provided within the concentration adjustment tank 71Y, which prevents imbalances in the concentration of the developer within the concentration adjustment tank 71Y by agitating the collected developer and unused toner and carrier liquid. In addition, a concentration detection sensor 73Y is provided within the concentration adjustment tank 71Y, and depending on the detected concentration, the concentration within the concentration adjustment tank 71Y is controlled to a desired value by controlling the amount of the high-concentration developer transported from the high-concentration developer tank 74Y and the amount of the carrier liquid transported from the carrier liquid tank 75Y.

The developer whose concentration has been adjusted by the concentration adjustment tank 71Y in such a manner is supplied to the developer holding unit 311Y and is reused in developing. Although the developer holding unit 311Y and the collected liquid holding portion 312Y are partitioned within the developer reservoir 31Y, it should be noted that the configuration is such that the collected developer within the collected liquid holding portion 312Y does not leak into the developer holding unit 311Y, and thus the adjusted developer concentration is not disturbed.

A configuration in the periphery of the photosensitive member 10Y for achieving the reuse of developer has been described thus far, and with this embodiment, by reusing carrier liquid-rich collected material collected by the photosensitive member cleaning blade 18Y (a "cleaning unit" according to the invention) in the cleaning apparatus 80 that cleans the transfer belt 40 (a "transfer member" according to the invention), the efficiency with which the developer is used is improved, and a reduction in the size of the cleaning apparatus 80 and the image forming apparatus is achieved by a reduction in the number of components.

In this embodiment, the collected material collected by the photosensitive member cleaning blade 18Y is supplied to the cleaning apparatus 80 from the collected liquid buffer tank 77Y. By once holding the collected material in the collected liquid buffer tank 77Y, the tank 88 in the cleaning apparatus 80 can be prevented from running out of carrier liquid, and the volume of the tank 88 can be reduced, thus making it possible to reduce the size of the cleaning apparatus 80.

The carrier liquid-rich collected material held in the collected liquid buffer tank 77Y is supplied to the tank holding portion 882 within the tank 88 via a transport channel 771Y provided for each color and a transport channel 770 that is linked to the transport channels of each of the colors. The collected material transported to the tank holding portion 882 is transported by driving a supply pump 79, disposed in the transport channel 770, as appropriate. Although in this embodiment, a configuration in which the supply pump 79 is disposed in the transport channel 770 linked to the transport channels 771Y, 771M, 771C, and 771K of each of the colors, pumps may be disposed as transport units in the transport channels 771Y, 771M, 771C, and 771K instead. According to such a configuration, the amounts supplied to the tank 88 can be controlled in accordance with the amounts held in the collected liquid buffer tanks 77 for each of the colors.

The carrier liquid-rich collected material held in the tank 88 in this manner is supplied to the dripping unit 84 via a transport channel 883. Although in this embodiment, an application unit that applies the carrier liquid to the cleaning roller 81 is formed by the transport channel 883 from the tank 88 to the dripping unit 84, the dripping unit 84, the application roller 83, and the smoothing roller 85, any desired form may be employed for the application unit as long as it supplies the collected material to the cleaning roller 81 from the tank 88.

Furthermore, by reusing, in the cleaning apparatus 80, the carrier liquid that was used by the photosensitive members 10, the toner particles on the transfer belt 40 can be efficiently attracted toward the cleaning roller 81, and the toner particle collection efficiency can be increased. This is because a dispersant is intermixed with the developer used by the photosensitive members 10. Dispersants have a high affinity for solid components such as toner particles, and are known to increase the charging property of toner particles by adhering thereto. By reusing the carrier liquid that contains dispersant in the cleaning apparatus 80, toner particle to which the dispersant has adhered are attracted toward the cleaning roller 81, thus making it possible to improve the collection efficiency.

In this manner, the carrier liquid-rich collected material collected from the photosensitive members 10Y, 10M, 10C, and 10K is supplied to the tank holding portion 882 of the tank 88, and the supplied collected material is used in the supply of carrier liquid to the cleaning roller 81. Although the collected material held in the tank holding portion 882 also contains toner particles, the collected material collected from the photosensitive member 10Y is left over from the primary transfer, whereas the collected material collected by the cleaning roller cleaning blade 811 and the transfer belt cleaning blade 82 is left over from the secondary transfer, and thus the amount of intermixed toner particles does not present much of a problem in terms of the carrier liquid, aimed at cleaning, that is to be used in the cleaning roller 81.

However, in the case where the duration of usage and number of uses increase and the concentration of toner particles within the tank holding portion 882 has increased as a result, it is necessary to take measures to suppress the toner particle concentration in the collected material, such as discarding the collected material within the tank holding portion 882, replacing the tank 88 itself, and so on. Alternatively, the collected material may be sufficiently transported from the transport channel 770 to the tank holding portion 882, causing an overflow of collected material from the tank holding portion 882, thus suppressing the toner particle concentration within the tank holding portion 882. In such a case, the collected material that has overflowed is received by a disposal tank provided separately.

As described thus far, according to the first embodiment, the efficiency with which toner particles that have adhered to the transfer belt 40 are collected can be improved by using the cleaning roller 81, to which a bias is applied and to which carrier liquid is also applied. At this time, the carrier liquid applied to the cleaning roller 81 uses collected material obtained by cleaning the photosensitive members 10, and thus the efficiency with which the developer is used can be improved as well. Furthermore, the tank 88 is basically sufficient in terms of tanks disposed in the cleaning apparatus 80, and thus it is possible to achieve a reduction in the size of the cleaning apparatus 80 and the image forming apparatus.

Second Embodiment

Figure 7:
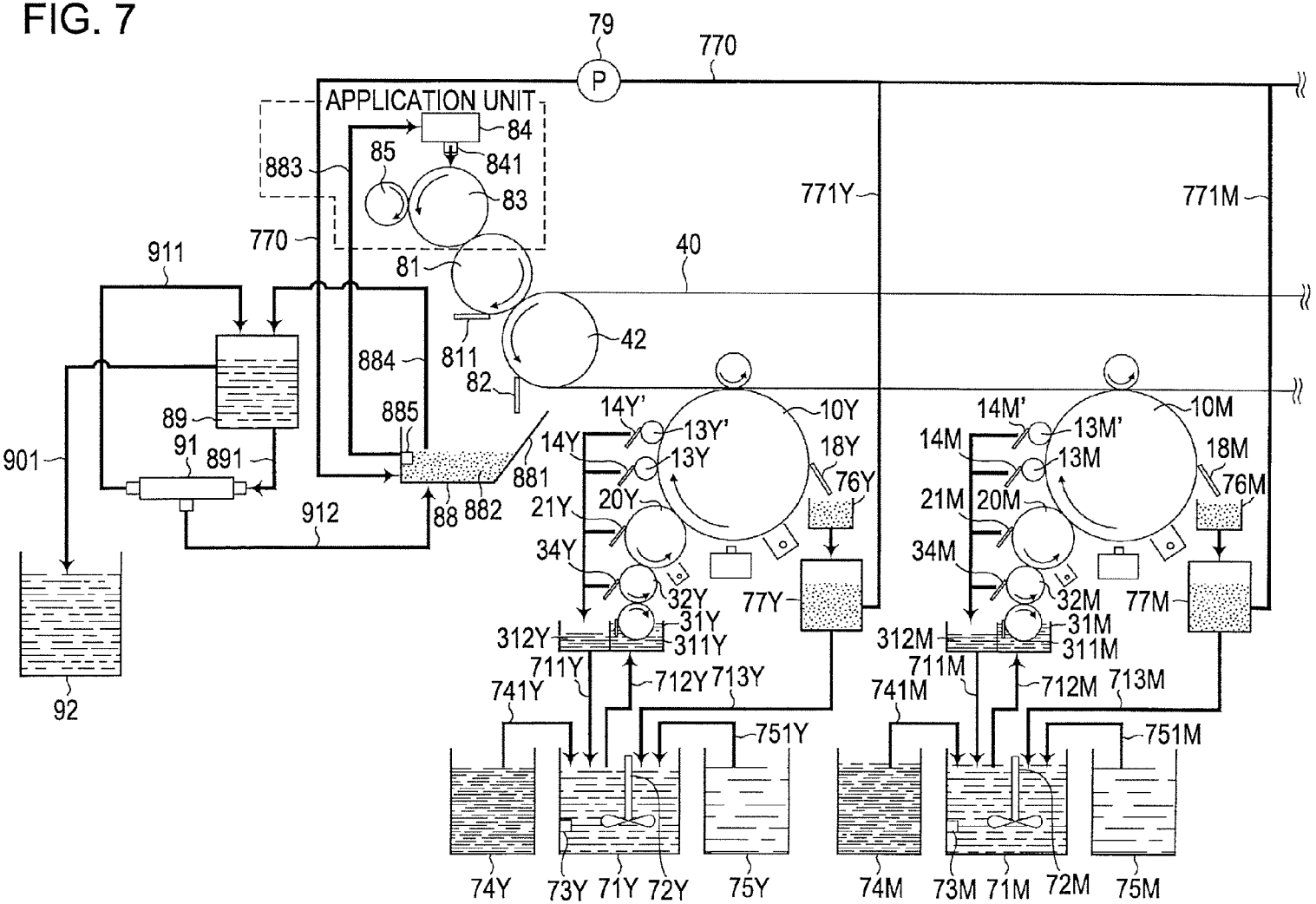
FIG. 7 is a diagram illustrating the transport of liquid developer according to another embodiment of the invention.

FIG. 7 is a diagram illustrating a second embodiment of the invention. The second embodiment differs from the first embodiment in the two following ways. (1) the collected material within the tank holding portion 882 is filtered (that is, toner particles are collected) by providing a buffer tank 89 and a filter unit 91; and (2) a concentration detection sensor 885 is disposed within the tank 88, and the supply pump 79 is controlled based on the detected concentration of the collected material. Points that are the same as in the first embodiment will be omitted hereinafter, and the descriptions will focus on the differing points only.

In the second embodiment, the collected material within the tank holding portion 882 is filtered (that is, toner particles are collected), and thus a configuration in which primarily the buffer tank 89 and the filter unit 91 (separating unit) are disposed is employed. Collected material within the tank holding portion 882 is transported to the buffer tank 89 via a transport channel 884. In addition to the transport channel 884, although particular descriptions are not added, it should be noted that any appropriate transport unit, such as a unit that actively controls the transport amount using pumps, valves, and so on, and a unit that transports overflowed material, and so on can be employed for the transport channels.

The collected material held in the buffer tank 89 is supplied to the filter unit 91 via a transport channel 891. The collected material filtered by the filter unit 91 is returned to the tank holding portion 882 via a transport channel 912. Providing the buffer tank 89 in this manner makes it possible to reduce the volume of the tank holding portion 882. The tank 88 is disposed in the vicinity of the transfer belt 40, which has many rotating parts, and thus the shape and volume of the tank is often limited; it is thus difficult to provide a tank with a sufficient volume. While providing the buffer tank 89 separately does increase the number of tanks by one, doing so also increases the amount of collected material that is held, and increases the freedom with which the layout can be determined. Furthermore, because the collected material held in the buffer tank 89 is filtered by the filter unit 91 and returned to the tank holding portion 882, it is possible to suppress the toner particle concentration within the tank holding portion 882 from increasing.

Figure 8:
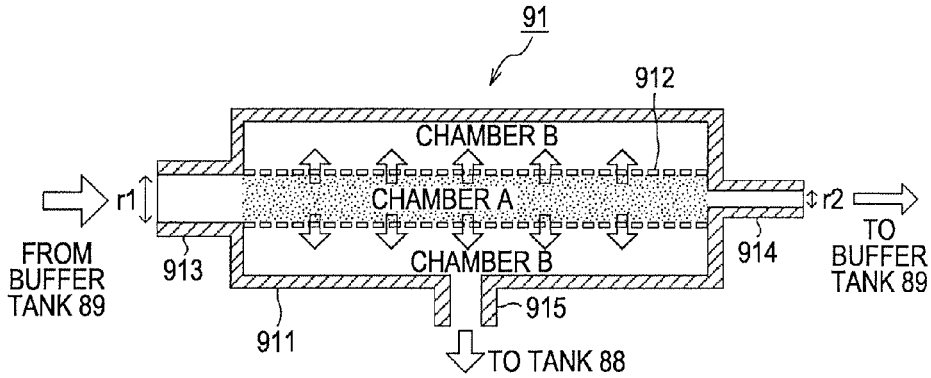
FIG. 8 is a diagram illustrating the configuration of a filter unit used in an embodiment of the invention.

FIG. 8 is a cross-sectional view illustrating the configuration of the filter unit 91 used in this embodiment. In this embodiment, a cross-flow filter unit 91 is employed, the primary constituent elements of which are an outer wall portion 911, an inner wall portion 912, an inflow portion 913, a first outflow portion 914, and a second outflow portion 915.

The collected material is taken in from the buffer tank 89 through the inflow portion 913, passes through a chamber A configured within the inner wall portion 912, passes through the first outflow portion 914, and is returned to the buffer tank 89. The diameter r2 of the first outflow portion 914 is made smaller than the diameter r1 of the inflow portion 913, so that the internal pressure of the chamber A increases. In addition, a porous material such as ceramics is used for the inner wall portion 912, and the carrier liquid, which is sufficiently smaller than the holes in the inner wall portion 912, passes through the inner wall portion 912 due to a rise in the internal pressure of the chamber A, and moves from the chamber A to a chamber B formed by the outer wall portion 911 and the inner wall portion 912. The chamber B is connected to the second outflow portion 915, and the filtered carrier liquid is returned to the tank 88 from the second outflow portion 915. Meanwhile, the collected material remaining after the filtration is returned to the buffer tank 89 from the first outflow portion 914.

Note that this cross-flow filter unit 91 is only one example, and any appropriate configuration or toner particle collection rate may be employed as long as the toner particles contained in the collected material are collected and the collected material is divided into collected material having a first toner particle concentration and collected material having a second toner particle concentration that is lower than the first toner particle concentration.

Next, a configuration in which the concentration detection sensor 885 is disposed within the tank 88 and the supply pump 79 is controlled based on the detected concentration of the collected material will be described. In this embodiment, the concentration detection sensor 885, which detects the concentration of the collected material within the tank holding portion 882, is disposed therein. Although the toner particle concentration of the collected material within the tank holding portion 882 becoming too great was described as impeding the cleaning of the cleaning roller 81 in the first embodiment, in this embodiment, in order to solve this problem, the concentration of the collected material within the tank holding portion 882 is monitored, and when the concentration has been determined to be high, more carrier liquid-rich collected material collected from the photosensitive members 10 is imported, thus suppressing the concentration of the collected material within the tank holding portion 882.

Figure 9:
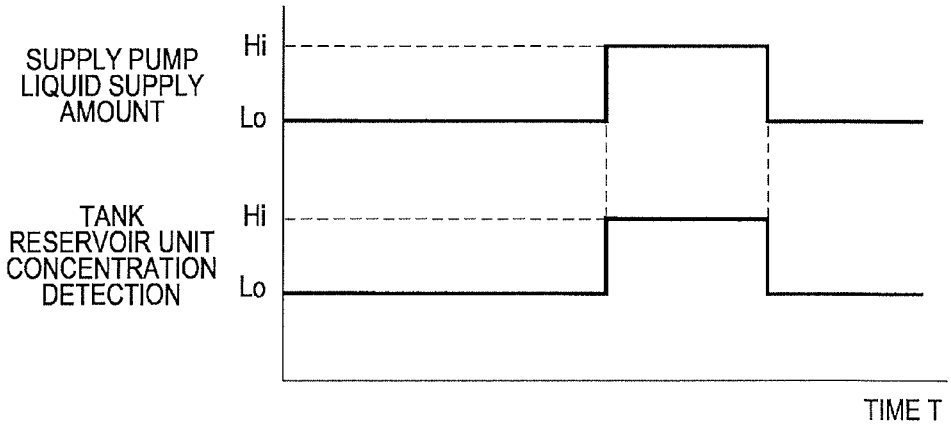
FIG. 9 is a diagram illustrating the control of a supply pump according to an embodiment of the invention.

FIG. 9 is a diagram illustrating a specific example of such control. In the case where a control unit has detected that the concentration within the tank holding portion 882 has exceeded a threshold, or in other words, has changed from Lo to Hi, the transport amount of the supply pump 79, which supplies the collected material from the photosensitive members 10, is increased from Lo to Hi. The amount of the carrier liquid-rich collected material supplied from the photosensitive members 10 increases in the tank holding portion 882, and thus the concentration of the collected material within the tank holding portion 882 drops. The control unit decreases the transport amount of the supply pump 79 from Hi to Lo in the case where the concentration within the tank holding portion 882 has dropped below the threshold. Through such a configuration, it is possible to maintain a low concentration in the collected material within the tank holding portion 882.

Note that the control of the concentration detection sensor 885 and the supply pump 79 is not limited to Hi and Lo only; multi-level control may be carried out instead. Furthermore, the reduction of the transport amount or stopping of the transport by the supply pump 79 is not limited to being based on the detection of the concentration, and may be carried out based on a predetermined amount in the supply pump 79 or the passage of a predetermined amount of time. To rephrase, it is sufficient for the control of the supply pump 79 based on the concentration detection sensor 885 to be executed at least when the concentration within the concentration detection sensor 885 has become high.

Although in this embodiment, the control performed by the control unit based on the concentration detection sensor 885 involved only the adjustment, by the supply pump 79, of the amount of collected material that flows into the tank holding portion 882, the control unit may adjust the amount that flows out to the buffer tank 89 through the transport channel 884 based on the toner particle concentration detected by the concentration detection sensor 885. Control of the amount that flows out is carried out by driving control of a pump (not shown) disposed in the transport channel 884. When the toner particle concentration has increased in the tank holding portion 882, the amount of high-concentration collected material within the tank holding portion 882 is reduced by causing the collected material to flow out from the tank holding portion 882 to the buffer tank 89, and it is thus possible to increase the effectiveness of the drop in concentration resulting from the collected material flowing in due to the supply pump 79.

The second embodiment has been described thus far, focusing on the points that are different from the first embodiment. In the second embodiment, a configuration in which a disposal tank 92 is further connected to the buffer tank 89 via a transport channel 901 is employed. Collected material that exceeds the predetermined amount of the buffer tank 89 can be held in the disposal tank 92. With respect to the transport of the collected material from the buffer tank 89 to the disposal tank 92, a configuration in which the collected material that has overflowed from the buffer tank 89 is simply sent to the disposal tank 92 may be employed, or a configuration in which the liquid level within the buffer tank 89 is monitored using a sensor and a predetermined amount of collected material is transported to the disposal tank 92 when a predetermined amount has been exceeded may be employed.

Third Embodiment

Figure 10:
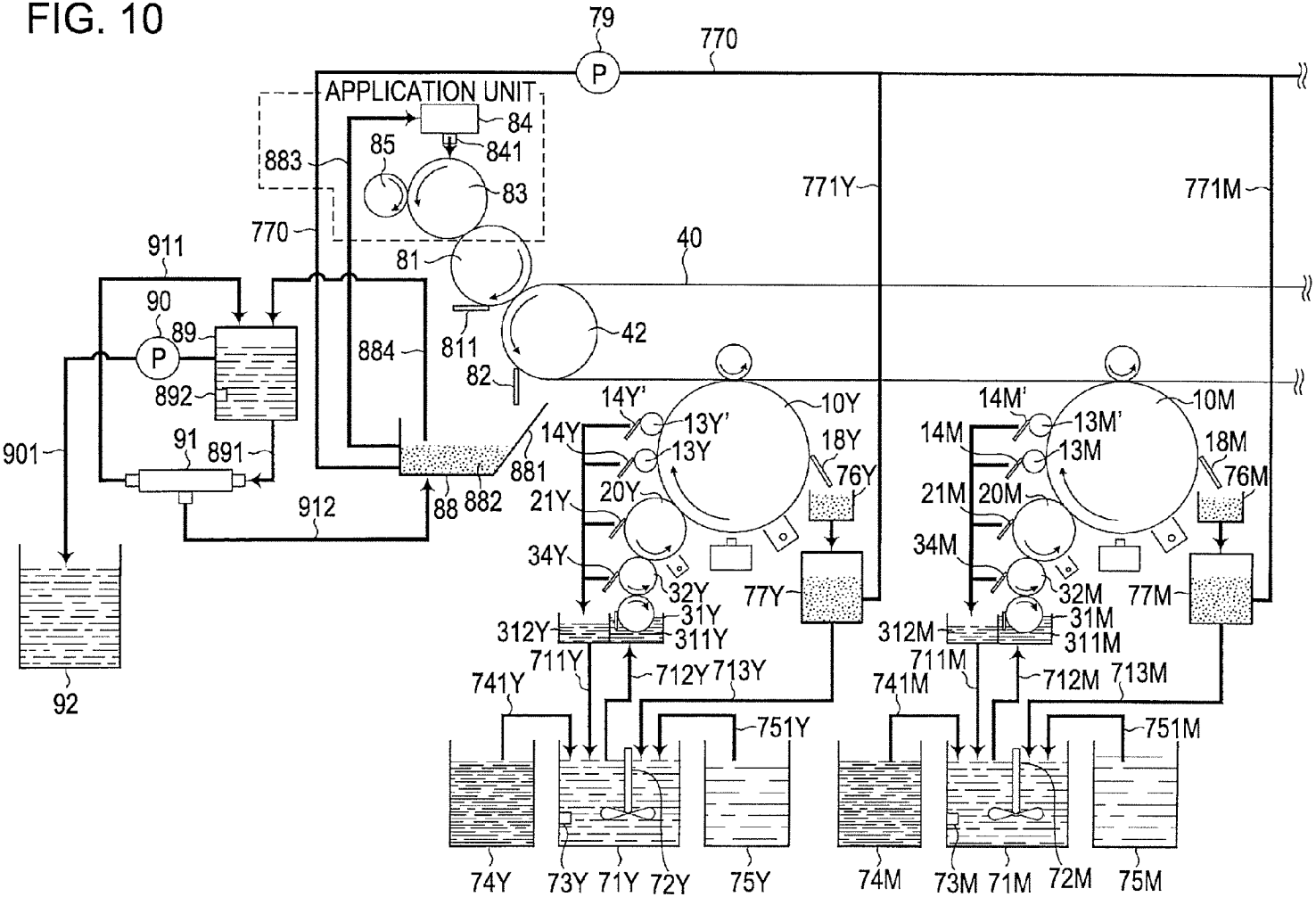
FIG. 10 is a diagram illustrating the transport of liquid developer according to another embodiment of the invention.

FIG. 10 is a diagram illustrating a third embodiment of the invention. The third embodiment differs from the first embodiment in the two following ways. (1) the collected material within the tank holding portion 882 is filtered by providing the buffer tank 89 and the filter unit 91; and (2) a concentration detection sensor 892 is disposed within the buffer tank 89, and a disposal pump 90 is controlled based on the detected concentration of the collected material. Hereinafter, points that are the same as in the first embodiment and that have been described already in the second embodiment with respect to (1) will be omitted, and detailed descriptions will be given regarding (2).

In this third embodiment, the concentration within the buffer tank 89 can be suppressed from increasing by disposing the concentration detection sensor 892 within the buffer tank 89 as described in the second embodiment and disposing of collected material in the buffer tank 89 based on the detected concentration. Accordingly, the configuration includes the concentration detection sensor 892 disposed within the buffer tank 89, the disposal pump 90, the disposal tank 92, and the transport channel 901.

Figure 11:
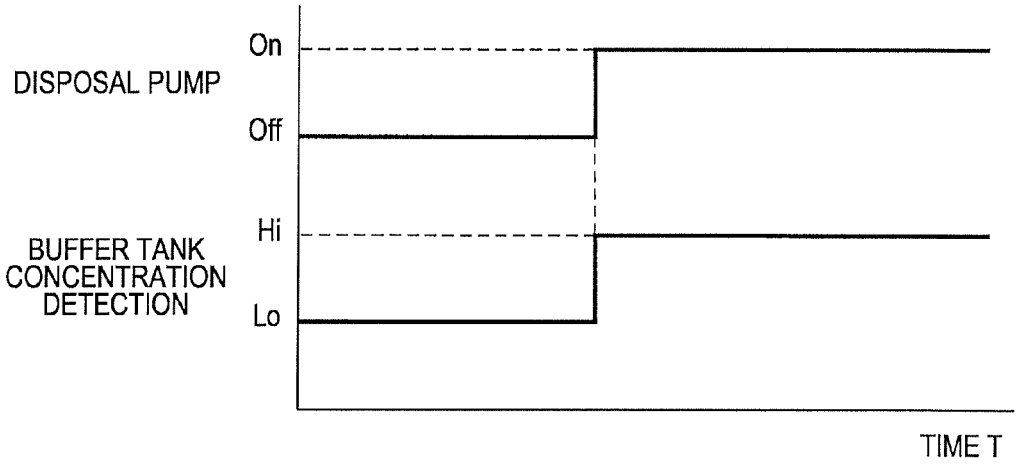
FIG. 11 is a diagram illustrating the control of a disposal pump according to an embodiment of the invention.

The disposal tank 92 is connected to the buffer tank 89 via the transport channel 901. The disposal pump 90 is disposed within the transport channel 901, and controls the transport of collected material from the buffer tank 89 to the disposal tank 92. FIG. 11 is a diagram illustrating the control of the disposal pump 90; in the case where the concentration of the collected material within the buffer tank 89 has changed from Lo to Hi, or in other words, in the case where concentration has exceeded a predetermined threshold, the disposal pump 90 is turned on, thus transporting the collected material in the buffer tank 89 whose concentration has become high to the disposal tank 92. The disposal pump 90 causes a predetermined amount of collected material to be transported to the disposal tank 92, or stops this operation when a predetermined amount of the collected material is reached in the buffer tank 89.

In this manner, according to the third embodiment, it is possible to suppress the concentration of the collected material within the buffer tank 89, and possible to supply low-concentration collected material to the tank holding portion 882. In particular, in the case where a configuration in which the collected material in the buffer tank 89 is filtered by the filter unit 91 is employed, the concentration of the collected material that flows into the filter unit 91 can be suppressed, which makes it possible to reduce the burden on the filter unit 91 and lengthen the lifespan of the filter unit 91.

Although various embodiments of the invention have been described in this specification, other embodiments obtained by combining, as appropriate, the configurations described in the preceding embodiments also fall within the scope of the invention.

The entire disclosure of Japanese Patent Application No: 2009-220638, filed Sep. 25, 2009 is expressly incorporated by reference herein.

What is claimed is:

1. An image forming apparatus comprising:

a latent image bearing member on which a latent image is formed;

a developing unit that develops the latent image formed on the latent image bearing member using a liquid developer containing toner particles and a carrier liquid;

a transfer member onto which the image developed on the latent image bearing member by the developing unit is transferred;

a cleaning unit that cleans the latent image bearing member;

a cleaning roller, to which a bias is applied, that cleans the transfer member by making contact with the transfer member;

a blade that cleans the cleaning roller by making contact with the cleaning roller;

a cleaning blade that cleans the transfer member cleaned by the cleaning roller by making contact with the transfer member;

a holding unit that holds collected material scratched by the blade and the cleaning blade;

an application unit that applies the collected material held in the holding unit to the cleaning roller; and a transport channel that transports the collected material collected by the cleaning unit to the holding unit.

2. The image forming apparatus according to claim 1, further comprising:

a second transport channel that transports the collected material held in the holding unit to a second holding unit; and a third transport channel that transports the collected material held in the second holding unit to the holding unit.

3. The image forming apparatus according to claim 2, further comprising a filter unit that collects toner particles contained in the collected material held in the second holding unit.

4. The image forming apparatus according to claim 2, further comprising:

a concentration detection unit that detects a concentration of toner particles in the collected material held in the holding unit; and a control unit that controls the transport of the collected material held in the holding unit based on the concentration of the toner particles in the collected material detected by the concentration detection unit.

5. The image forming apparatus according to claim 4, wherein the control unit controls an amount of collected material transported through the second transport channel.

6. The image forming apparatus according to claim 4, wherein the control unit controls an amount of collected material transported through the transport channel.

7. The image forming apparatus according to claim 2, further comprising:

a second concentration detection unit that detects a concentration of toner particles in the collected material held in the second holding unit;

a third holding unit that holds the transported collected material to be held in the second holding unit; and a fourth transport channel that transports the collected material held in the second holding unit to the third holding unit, wherein the control unit controls an amount of the collected material transported through the fourth transport channel based on the concentration of toner particles in the collected material held in the second holding unit detected by the second concentration detection unit.

8. An image forming method comprising:

developing a latent image formed upon a latent image bearing member using a liquid developer containing toner particles and a carrier liquid;

transferring the image developed on the latent image bearing member onto a transfer member;

cleaning the latent image bearing member using a cleaning unit;

transporting collected material collected by the cleaning unit to a holding unit;

cleaning the transfer member by causing a cleaning roller to which a bias is applied to make contact with the transfer member;

cleaning the cleaning roller by causing a blade to make contact with the cleaning roller;

cleaning the transfer member that has been cleaned by the cleaning roller by causing a cleaning blade to make contact with the transfer member;

holding the collected material scratched by the blade and the cleaning blade in the holding unit, and holding the collected material collected by the cleaning unit in the holding unit; and applying the collected material held in the holding unit to the cleaning roller.

* * * * *